US006079949A

United States Patent [19]

Litvin

[11] Patent Number: 6,079,949

[45] Date of Patent: Jun. 27, 2000

[54] RATCHET ASSEMBLY FOR PEDESTAL FAN

[75] Inventor: Charles Litvin, West Chester, Pa.

[73] Assignee: Lasko Holdings, Inc., West Chester, Pa.

[21] Appl. No.: 09/191,351

[22] Filed: Nov. 13, 1998

[51] Int. Cl.[7] ..... F04D 29/64

[52] U.S. Cl. ..... 416/246; 248/292.12; 403/94

[58] Field of Search ..... 416/244 R, 246, 416/247 R; 403/92, 94, 97; 248/291.1, 292.12

[56] References Cited

U.S. PATENT DOCUMENTS

| | | | |
|---|---|---|---|
| 2,129,933 | 9/1938 | Hueglin | 248/291.1 |
| 4,815,740 | 3/1989 | Williams et al. | 403/97 |
| 5,265,969 | 11/1993 | Chuang | 403/94 |
| 5,429,481 | 7/1995 | Liu | 416/246 |
| 5,435,696 | 7/1995 | Cunning | 416/246 |
| 5,617,592 | 4/1997 | Cheng | 403/94 |

FOREIGN PATENT DOCUMENTS

| | | | |
|---|---|---|---|
| 56-135792 | 10/1981 | Japan | 416/247 R |
| 63-131895 | 6/1988 | Japan | 416/246 |

*Primary Examiner*—Christopher Verdier
*Attorney, Agent, or Firm*—Zachary T. Wobensmith, III

[57] ABSTRACT

A pedestal fan which has a ratchet assembly, which permits the fan to pivot vertically up and down, which is resistant to position change.

3 Claims, 5 Drawing Sheets

RATCHET ASSEMBLY FOR PEDESTAL FAN

BACKGROUND OF THE INVENTION

1. Field of the Invention

This invention relates to a pedestal fan of the type which has a fan carried on a single ratchet assembly for selective positioning of the fan.

2. Description of the Prior Art

Pedestal fans are well known in the art. Such fans allow positioning of the fan above the floor, and usually have a yoke attached to tubing which is carried in a base, the yoke being attached to the fan by a pair of thumbscrews, which extend through the ends of the yoke into captive nuts in the grills surrounding the fan blades. An example of such fans is shown in my prior U.S. Pat. No. 5,368,445. While these fans are satisfactory, the yoke style of mounting the fan requires that the two thumbscrews be loosened to rotate the fan and then tightened. Due to the frictional forces between the yoke and the thumbscrews, these fans may not stay in the position where they are placed and the fan may rotate to an undesirable position due to loosening of the thumbscrews.

It is desirable to reduce the number of parts and to provide a fan that can be rotated without the necessity of loosening or tightening any thumbscrews, and which fan is retained in the position where it is placed.

The pedestal fan of the invention can be readily positioned for air flow and the direction maintained or varied, and which provides other positive advantages.

SUMMARY OF THE INVENTION

In accordance with the invention a pedestal fan is provided, which includes a fan carried on a ratchet assembly that can be readily pivoted without loosening or tightening of thumbscrews, and which fan stays where it is positioned.

The principal object of the invention is to provide a pedestal fan with a ratchet assembly that can readily position the fan for air flow, and which retains the position.

A further object of the invention is to provide a pedestal fan which is long lasting and durable in service.

A further object of the invention is to provide a pedestal fan which has provisions for varying the resistance to changing its position.

A further object of the invention is to provide a pedestal fan which is easy to manufacture and contains a large number of molded plastic components.

Other objects and advantageous features of the invention will be apparent from the description and claims.

DESCRIPTION OF THE DRAWINGS

The nature and characteristic features of the invention will be more readily understood from the following description taken in connection with the accompanying drawings in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
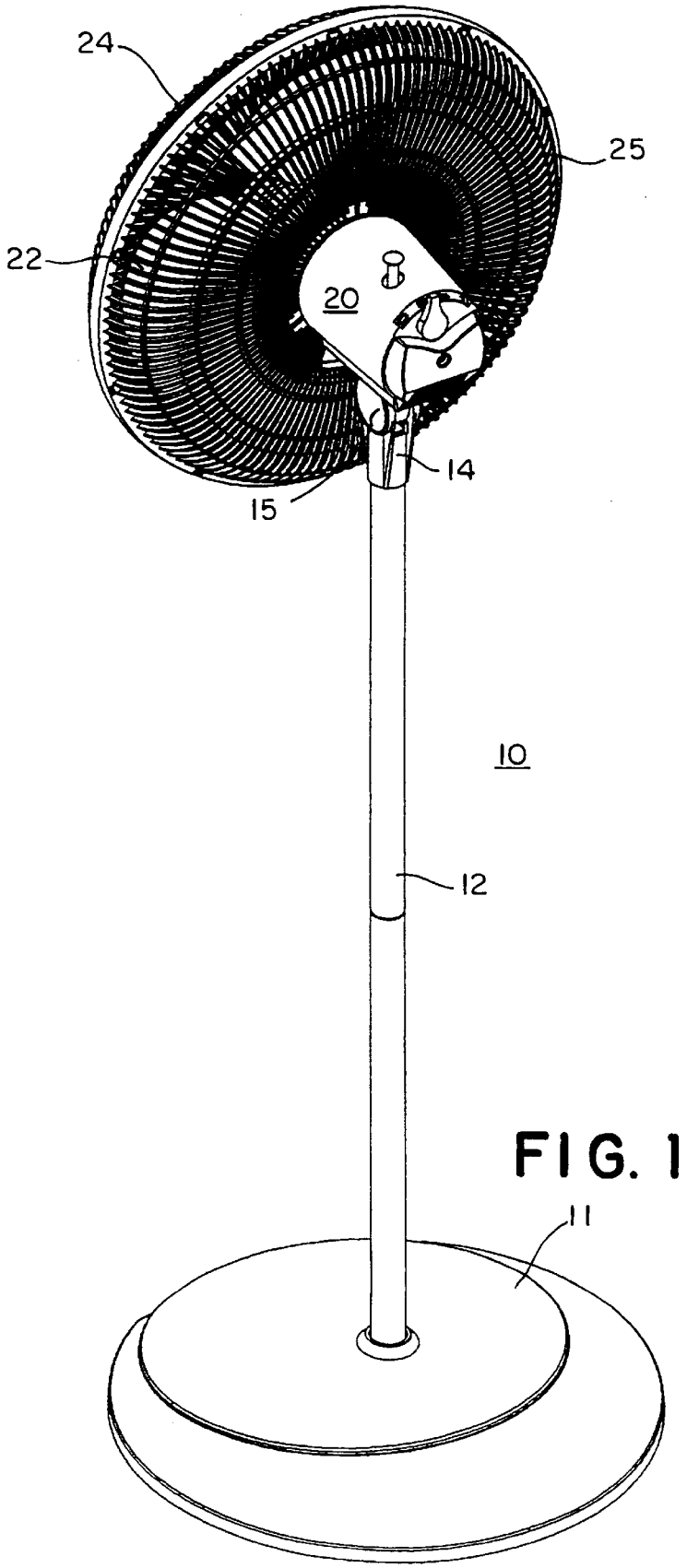
FIG. 1 is a perspective view of a pedestal fan incorporating the invention.
Figure 2:
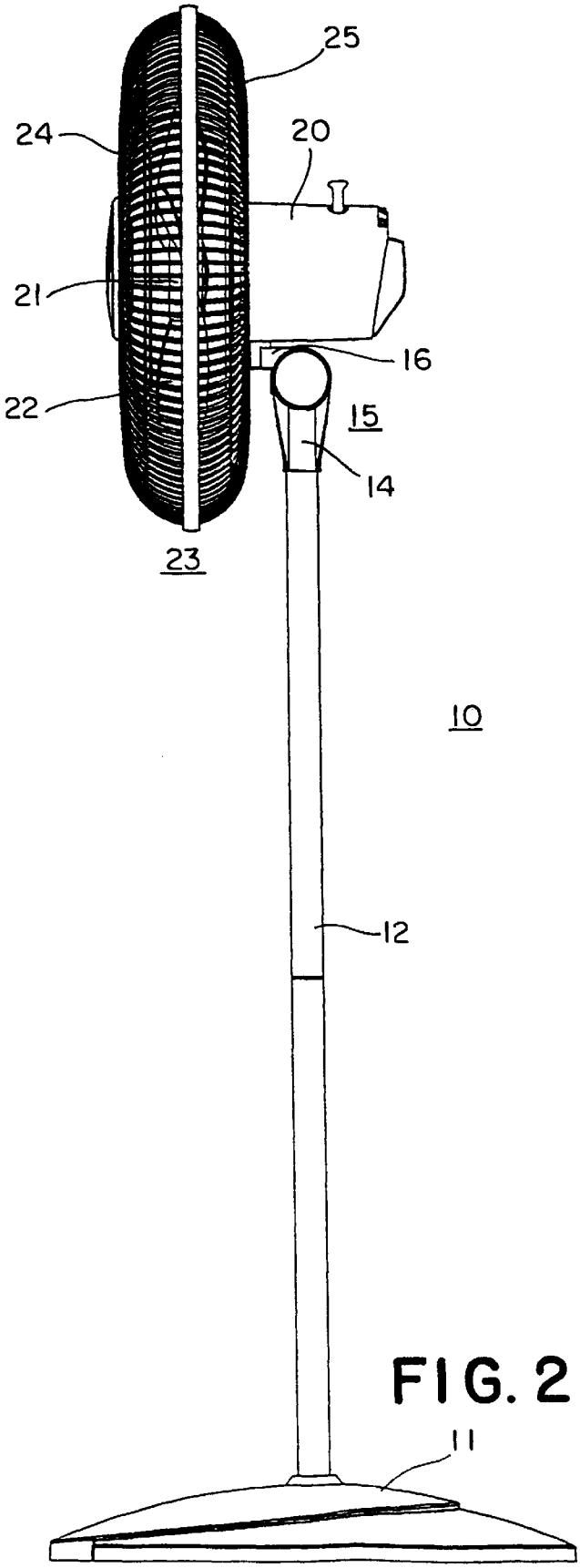
FIG. 2 is a side elevational view of the pedestal fan of FIG. 1.
Figure 3:
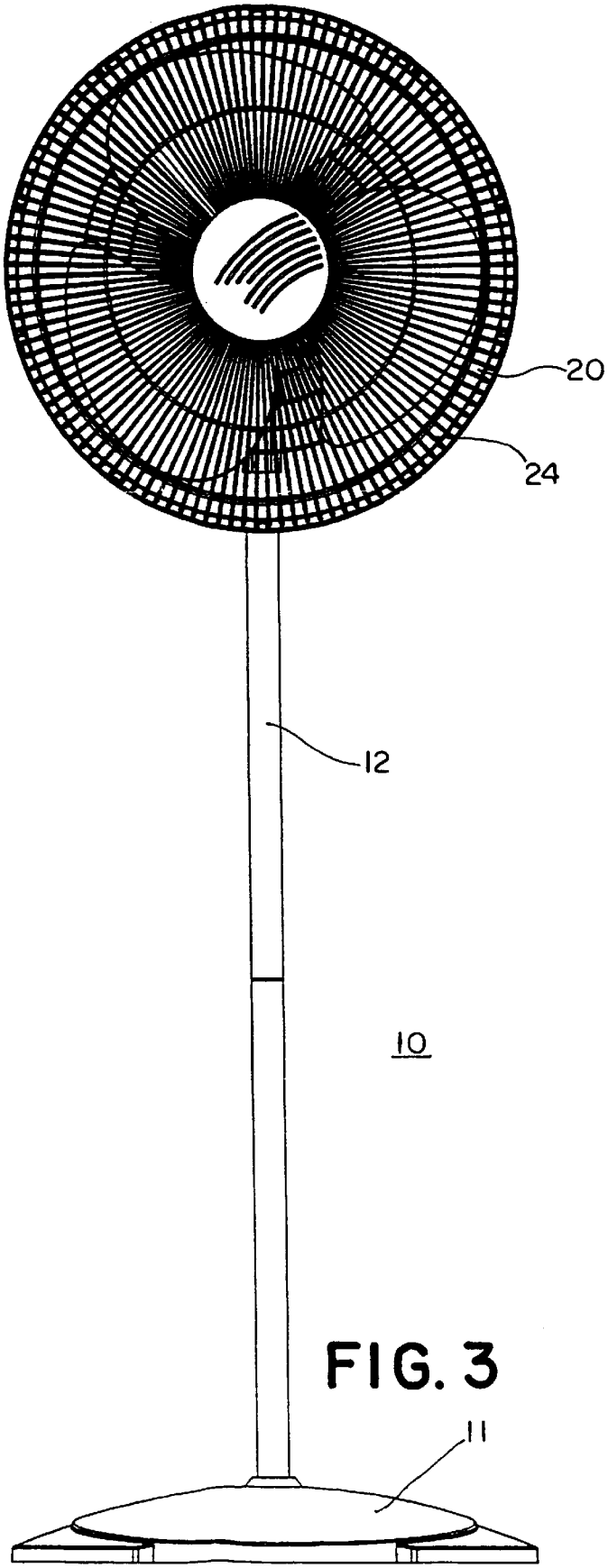
FIG. 3 is a front elevational view of the pedestal fan of FIG. 1.

Referring now more particularly to FIGS. 1–3 of the drawings, a pedestal fan 10 is therein illustrated. The pedestal fan includes a round base 11 with a length of tubing 12 carried therein, and which can be of multiple pieces.

The tubing 12 has an extension 14 from a ratchet assembly 15 engaged therewith, and secured thereto in well known manner.

The ratchet assembly 15 has a neck 16, to be described which has a fan motor assembly 20 attached thereto in well known manner, and which can be rotated about the ratchet assembly 15.

The fan motor assembly 20 has a fan hub 21 extending therefrom, with a plurality of fan blades 22 which are encased in a fan grill 23. The fan grill 23 is of two piece front and rear 24 and 25 construction, with the rear piece 25 attached to the fan motor assembly 20 in well known manner.

Figure 4:
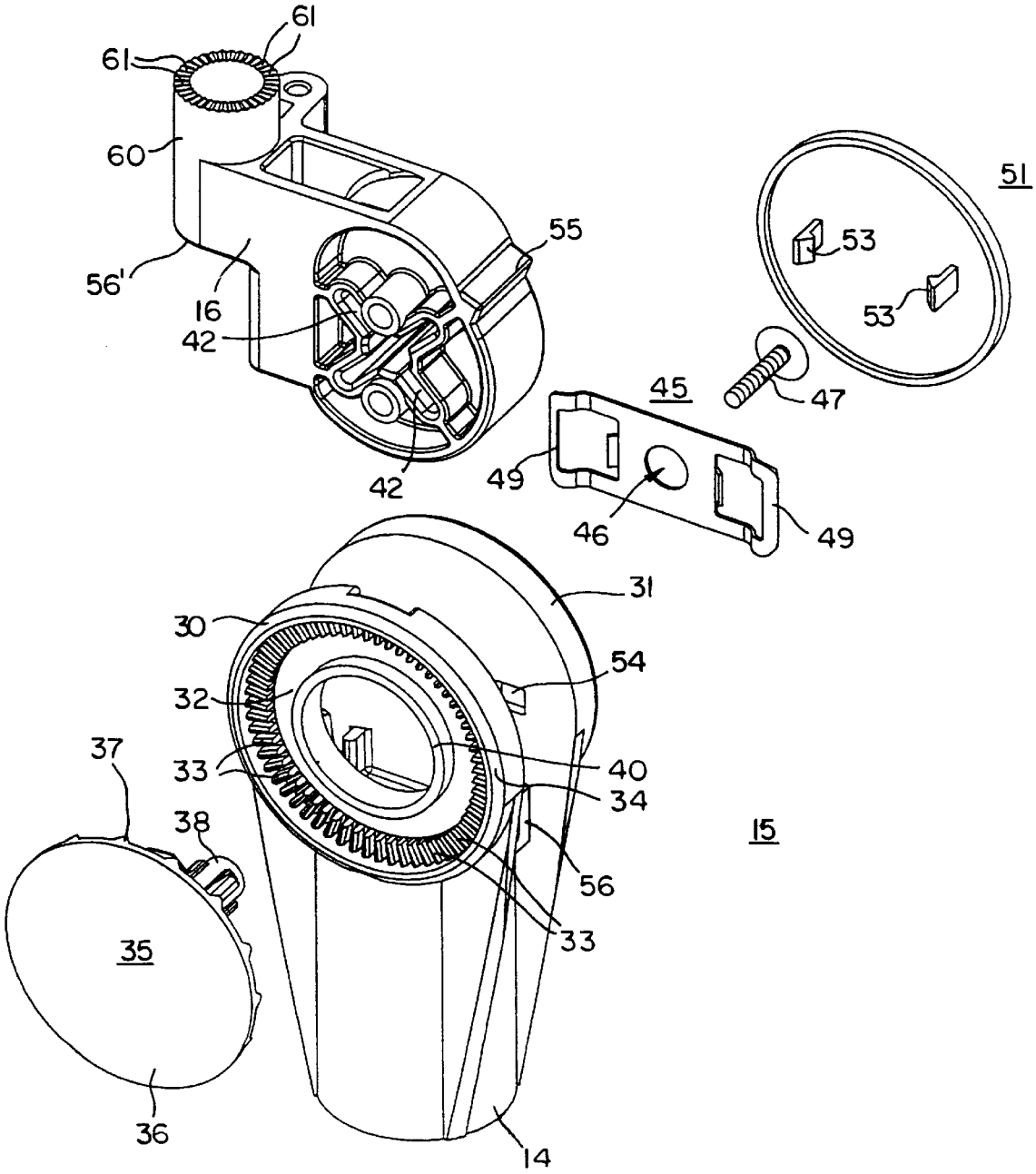
FIG. 4 is an exploded perspective view of the ratchet assembly of the pedestal fan of FIG. 1 from the left side.
Figure 5:
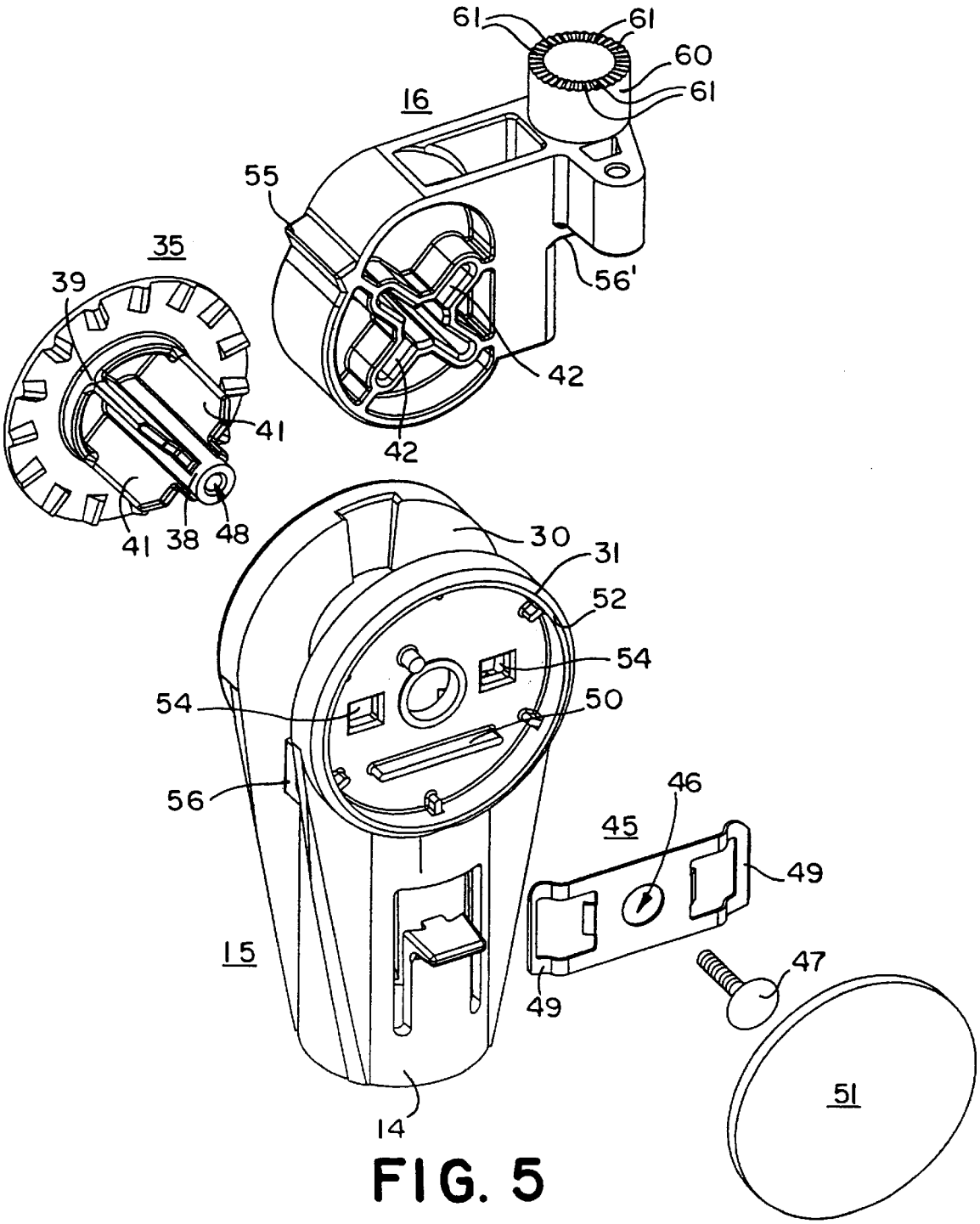
FIG. 5 is a view similar to FIG. 4, but from the right side.

Referring additionally to FIGS. 4 and 5 the ratchet assembly 15 is therein illustrated, the extension 14 has a pair of spaced walls 30 and 31 with a slot therebetween, which retains the neck 16 therein, which neck 16 can pivot vertically through an angle of 90°.

The wall 30 has a circular portion 32, which has a plurality of radially extending teeth 33 around the perimeter inside of an outer rim 34. A ratchet 35 is provided which includes a circular top 36, which fits inside of rim 34 and has a plurality of teeth 37 around the perimeter, which are intended to mesh with teeth 33 in assembled condition.

The ratchet 35 has a shaft 38 extending therefrom with an inner rim 39, which is intended to fit into an inner rim 40 of wall 30. The shaft 38 has a plurality of blades 41 extending therefrom, which are intended to engage slots 42 in the neck 16. A semi-flat spring 45 is provided, which has a central opening 46 to receive the shaft 38, with a serrated push pin 47 which engages in an opening 48 in shaft 38 compressing the spring 45.

The spring 45 has raised ends 49 and the spring 45 is engaged with a shelf 50 in side wall 31, retaining the spring 45 from rotation, but permitting compression.

A cover 51 is provided of circular configuration, which fits inside outer rim 52 of wall 31, and which has two snap in tongues 53 which engage openings 54 in side wall 31.

The neck 16 has a detent 55 and shoulder 56' to limit the pivotal movement of neck 16 which engage with stops 56, which span the side walls 30 and 31.

The neck 16 has an upstanding cylindrical portion 60, which has a plurality of serrations 61 therearound, which are intended to mate with like serrations (not shown), from a bracket (not shown), carried by the fan motor assembly 20, which permits horizontal fan rotation.

The extension 14, neck 16, ratchet 30, pin 47, and cover 51 are all preferably fabricated of molded plastic.

The mode of operation will now be described.

The ratchet assembly is constructed by placing the extension 14 on the tubing 12, the neck 16 placed between the walls 30 and 31, the blades 41 of ratchet 35 are engaged in slots 42, the spring 45 is placed on shaft 38, and pin 47 pressed into opening 48 in shaft 38, compressing spring 45 and causing teeth 37 to engage teeth 33 and restrain pivotal movement of neck 16.

The fan motor assembly 20 is attached to neck 16 and the fan positioned by rotation of neck 16, which causes compression of spring 45, and teeth 37 ride over teeth 33 until a selected position is reached, whereupon the spring 45 force causes teeth 37 and 33 to mesh retaining ratchet 35 in the selected position.

It will thus be seen that structure has been provided with which the objects of the invention are attained.

I claim:

1. In a pedestal fan, which includes a base, tubing in said base, a fan housing, ratchet means in connecting relation with said tubing and said fan housing, the improvement which comprises said ratchet means includes an extension connected to said tubing, said extension has a pair of spaced side walls, neck means between said side walls, and movable therebetween, said neck means including a circular portion, said fan housing connected to said circular portion, and rotatable thereabout, one of said side walls having a plurality of radially extending teeth spaced therearound, a ratchet adjacent said one of said side walls having a plurality of spaced radially extending teeth spaced therearound and in contact with said side wall teeth, said ratchet having a shaft extending therefrom spanning said side walls, a spring carried by said other of said side walls, an opening in said spring to receive said shaft, an opening in said shaft, a serrated push pin in said shaft opening engaged with said spring and compressing said spring thereby urging said ratchet teeth into engagement with said side wall teeth, a plurality of blades extending along said shaft, a plurality of slots in said neck means to receive said blades, whereby vertical pivotal rotation of said neck is restrained by the engagement of said ratchet teeth and said side wall teeth.

2. A pedestal fan as defined in claim 1 in which said extension, said neck means, said ratchet and said pin are formed of molded plastic.

3. A pedestal fan as defined in claim 1 in which said neck means has a detent thereon, and said extension has at least one stop which engages said detent to limit the extent of pivotal rotation.

* * * * *